US005158422A

United States Patent [19]

Wagner

[11] Patent Number: 5,158,422

[45] Date of Patent: Oct. 27, 1992

[54] METHOD AND APPARATUS FOR SHAPING AND FINISHING LENSES

[75] Inventor: Mark D. Wagner, Charlottesville, Va.

[73] Assignee: National Optronics, Inc., Charlottesville, Va.

[21] Appl. No.: 662,947

[22] Filed: Mar. 1, 1991

[51] Int. Cl.[5] ..... B23C 3/00

[52] U.S. Cl. ..... 409/84; 51/101 LG; 51/284 E; 409/104

[58] Field of Search ..... 409/84, 93, 109, 110, 409/111, 104, 123, 130, 132; 51/101 LG, 105 LG, 284 E

[56] References Cited

U.S. PATENT DOCUMENTS

| | | | |
|---|---|---|---|
| 2,333,064 | 1/1941 | Williams et al. . | |
| 3,087,285 | 4/1963 | Lissac . | |
| 3,332,172 | 11/1964 | Stern . | |
| 3,745,720 | 7/1973 | Savage . | |
| 3,775,908 | 12/1973 | Meckler et al. | 51/101 LG |
| 3,798,844 | 3/1974 | Hannaman . | |
| 3,828,648 | 8/1974 | Geula . | |
| 3,894,361 | 7/1975 | Georgiadis et al. . | |
| 4,179,851 | 12/1979 | Neisler et al. . | |
| 4,191,501 | 3/1980 | Sinklier et al. . | |
| 4,203,259 | 5/1980 | Haddock . | |
| 4,373,298 | 2/1983 | Tusinski et al. . | |
| 4,394,099 | 7/1983 | Santinelli . | |
| 4,403,420 | 9/1983 | Rarick . | |
| 4,493,168 | 1/1985 | Field, Jr. . | |
| 4,640,055 | 2/1987 | Badin et al. . | |
| 4,807,398 | 2/1989 | Ramos et al. | 51/101 LG |
| 4,909,679 | 3/1990 | Berger et al. . | |

FOREIGN PATENT DOCUMENTS

| | | |
|---|---|---|
| 3343214A1 | 6/1985 | Fed. Rep. of Germany . |

*Primary Examiner*—Daniel W. Howell

*Attorney, Agent, or Firm*—Joseph W. Berenato, III

[57] ABSTRACT

The preferred embodiment is directed to a lens shaper and finisher which can readily accommodate large sized lens blanks. The preferred embodiment includes a chuck for supporting a lens blank and a lens pattern. A cutter is operably associated with the chuck. A plurality of piston and cylinder assemblies displace the chuck relative to the cutter between a first position wherein the lens blank is removed from the cutter and a second position wherein the lens blank engages the cutter. A control device is operably connected to a least one of the piston and cylinder assemblies to vary the rate at which the lens blank is fed to the cutter. Accordingly, the feed rate may be readily adjusted such that during a rough cutting cycle a lens blank is fed at a slower rate than during a finish cutting cycle to reduce the likelihood of shattering of the lens blank during the cutting process.

24 Claims, 8 Drawing Sheets

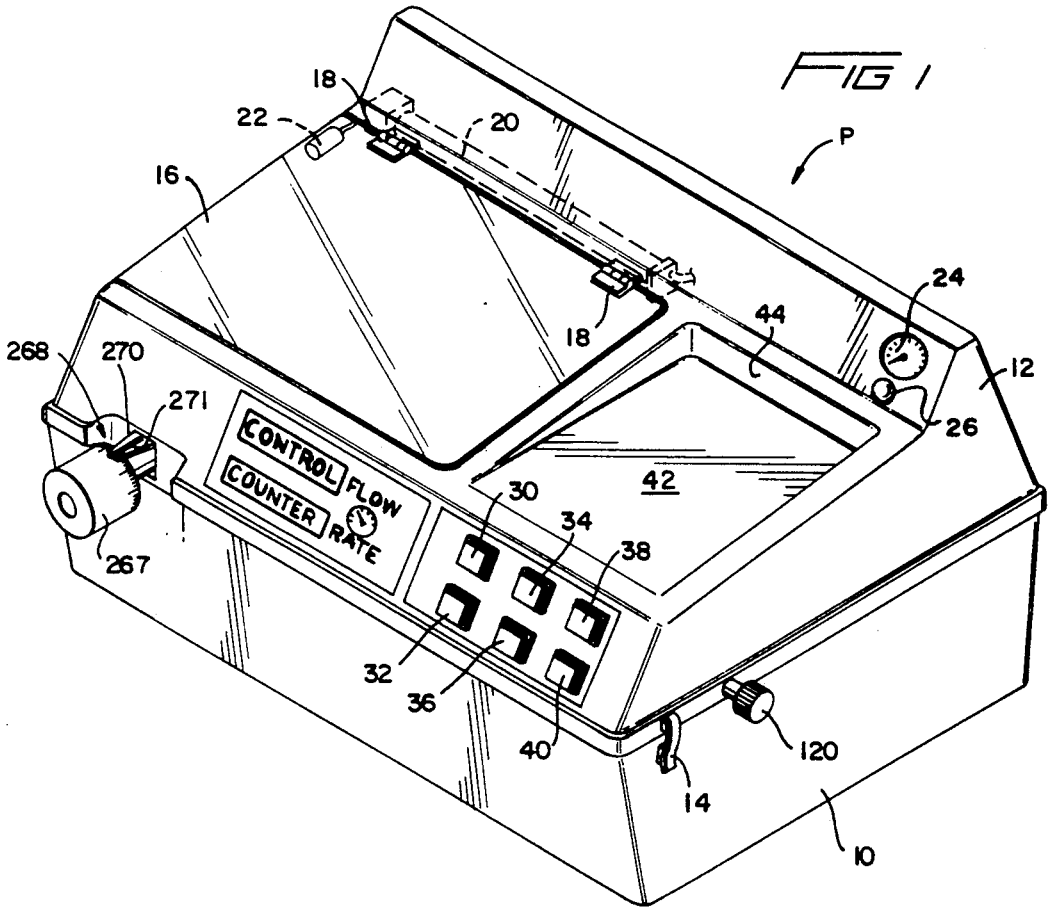
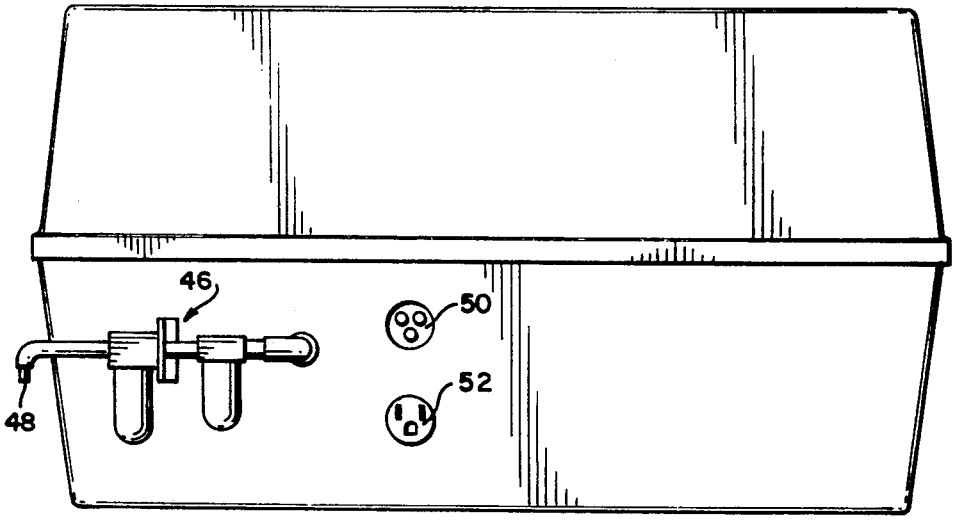
FIG 2

METHOD AND APPARATUS FOR SHAPING AND FINISHING LENSES

FIELD OF THE INVENTION

The present invention is directed to method and apparatus for shaping and finishing lenses. More specifically, a preferred embodiment of the present invention is directed to method and apparatus for shaping and finishing the edges of eyeglass lenses to conform to the contour of a predetermined size and style frame.

BACKGROUND OF THE INVENTION

A variety of sizes and styles of eyeglass frames are available to the consumer. Accordingly, it has been necessary for opticians and technicians to be able to shape and finish eyeglass lenses to fit in a plurality of different sizes and style of eyeglass frames. A number of devices have been previously made available to opticians and technicians to shape and finish lenses to conform to a predetermined style and size frame. It is customary for frame makers to supply opticians and technicians with a pattern or patterns which are used in conventional shaping and finishing devices to cut lens blanks to fit in a predetermined style and size frame. The lens blanks are commonly formed from CR39, acrylic and polycarbonate compositions. Recently, the size of lens blanks has increased to approximately 82 to 84 millimeters to accommodate large and stylish frames. Some conventional lens shapers and finishers have encountered difficulties in processing lens blanks of this size. Specifically, the rate at which some conventional lens shapers and finishers feed blanks to the cutting tool is likely to cause blanks exceeding approximately 82 millimeters in size to shatter. This problem is further heightened by decentering of the lens blanks, which create an effective diameter of approximately 100 millimeters.

OBJECTS AND SUMMARY OF THE INVENTION

An object of the present invention is to overcome at least one of the disadvantages associated with prior known lens shaping and finishing devices.

Another object of the present invention is to provide a method of forming lenses for insertion into a frame which includes the steps of: providing chuck means for supporting a lens blank and a lens pattern; providing cutting means for cutting the lens blank to conform to the lens pattern; providing displacement means for displacing the cutting means relative to the chuck means; performing a rough cutting cycle on the lens blank; displacing the cutting means relative to the chuck means at a first feed rate during the rough cutting cycle; performing a finish cutting cycle on the lens blank; and displacing the cutting means relative to the chuck means at a second feed rate during the finish cutting cycle, the second feed rate being different from the first feed rate. The above method of forming lenses for insertion into eyeglass frames is a significant improvement over previously known shaping and finishing methods. Specifically, by providing a rough cutting cycle and a finish cutting cycle and differing the feed rate during such cycles, the likelihood of lens blanks shattering during the cutting process is reduced. Further, the above method reduces the processing time of the lens blanks.

A further object of the invention is to provide an apparatus for forming lenses for insertion into a frame which includes chuck means for supporting a lens blank and a lens pattern and cutting means for cutting the lens blank to conform to the lens pattern. Displacement means displace the cutting means relative to the chuck means. Control means control the rate of the relative displacement of the cutting means and the chuck means. The control means includes a first control valve and rate varying means for varying the rate at which the control valve is opened and closed to vary the rate of relative displacement of the cutting means and the chuck means. By providing the control means with a first control valve and rate varying means for varying the rate at which the control valve opens and closes, the above apparatus can readily accommodate plastic lens blanks having large diameters.

Yet still another object of the invention is to provide a retrofit kit for adapting a lens shaping machine to displace lens blanks relative to a router at a first feed rate to perform a rough cutting cycle and a second feed rate to perform a finish cutting cycle. The retrofit kit includes control means for controlling the rate of relative displacement between a lens blank and a router. The control means includes a control valve and rate varying means for varying the rate at which the control valve is opened and closed. Actuation means are provided for actuating the control means. The above recited retrofit kit enables an individual to readily modify a conventional lens shaping and finishing machine so that it can accommodate large size lens blanks without shattering the same during the shaping and finishing process.

These as well as other objects and advantages of the present invention will be readily appreciated from a review of the specification, the claims, and the accompanying drawings.

DETAILED DESCRIPTION OF THE DRAWINGS

FIG. 1 is a perspective view of the plastic lens shaper and finisher formed in accordance with the preferred embodiment of the present invention mounted in its case.

FIG. 2 is a rear elevational view of FIG. 1.

DETAILED DESCRIPTION OF THE INVENTION

Figure 3:
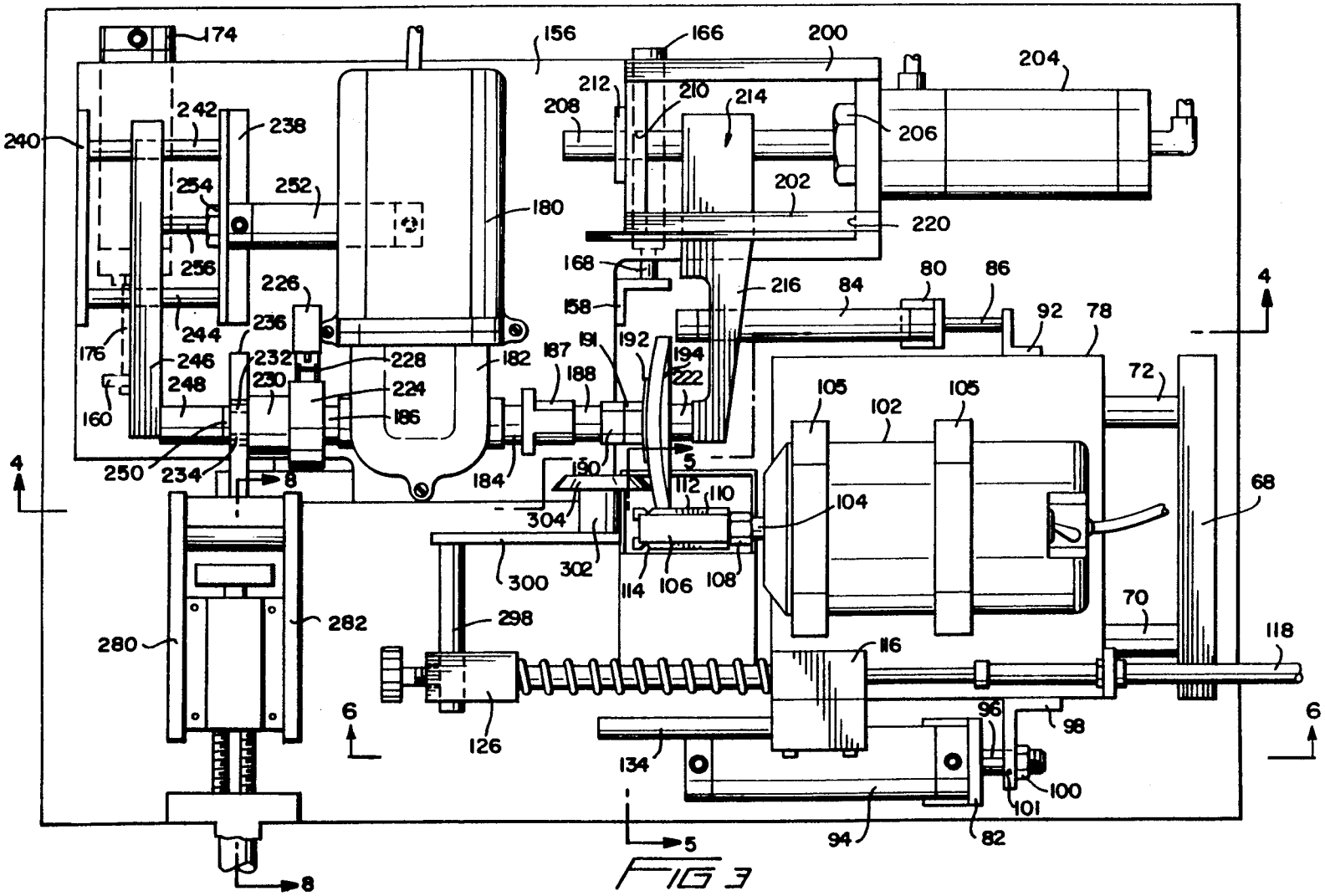
FIG. 3 is a top plan view of the preferred embodiment of the present invention with the case removed to permit viewing of the inner workings.

The preferred embodiment of the present invention will be described with reference made to FIGS. 1-11.

Plastic lens shaper and finisher P, as best shown in FIG. 1, is particularly intended for the shaping and finishing of plastic lenses, although use on other parts is not unanticipated. As used herein, plastic eyeglass lenses include lenses manufactured from CR 39, acrylic and polycarbonate compositions. Naturally, the continuing development of eyeglass technology may result in additional compositions being found suitable for use, and the present disclosure is not intended to be limited to the three listed compositions, they being merely illustrative.

Plastic lens shaper and finisher P has an enclosure comprised of bottom member 10 and cover member 12 hingedly connected thereto. Preferably, catch 14 secures cover member 12 to bottom member 10 and prevents unintended opening thereof. Cover member 12 has a clear window 16 mounted thereto by hinges 18, for reasons to be explained later. As illustrated in phantom lines in FIG. 1, electric light 20 is mounted to cover member 12 proximate window 16 to illuminate the device during operation. Also disclosed in FIG. 1 is mercury switch 22 secured to window 16 and pivotal therewith for safety reasons which will be further discussed.

FIG. 1 furthermore discloses tracking pressure gauge 24 and corresponding control knob 26 used in regulating the pneumatic control system which will be further explained. Also disclosed in FIG. 1 are control switches 30, 32, 34, 36, 38, 40 and 41 which are used in the operation of the device. It can be noted that cover member 12 includes a shell 42 having an upstanding peripheral wall 44 for holding job trays of finished and uncut blanks.

FIG. 2 discloses the filter assembly 46 as well as connection 48 to the air supply line (not shown). Also illustrated are plug connections 50 and 52 providing control and operating power for shaper and finisher P.

Figure 4:
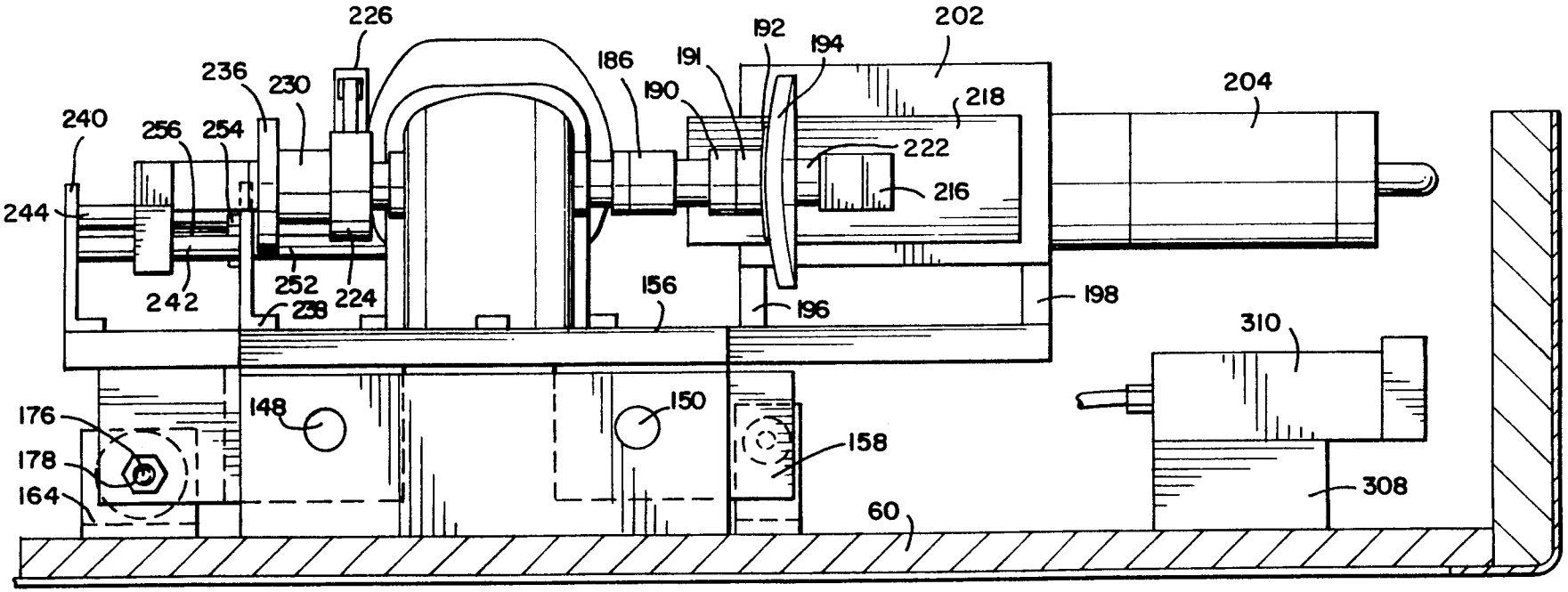
FIG. 4 is a fragmentary cross-sectional view taken along the section 4—4 of FIG. 3 and viewed in the direction of the arrows.

As best shown in FIG. 4, member 10 is a plastic shell which encloses metallic bed 60. Bed 60 has an upper planar surface 62. Sound damping insulation 64 extends along the side walls of member 10. While member 10 is disclosed as a plastic shell, those skilled in the art will appreciate that is can be constructed of other materials. Likewise, cover member 12 is also preferably a plastic shell.

Figure 6:
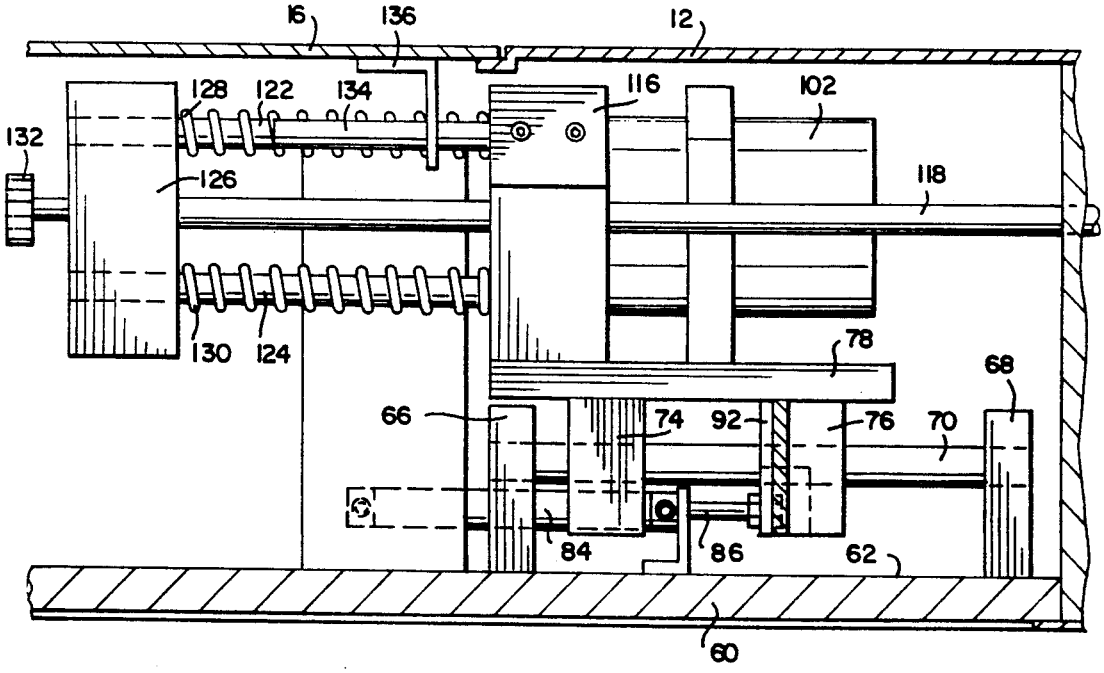
FIG. 6 is a fragmentary elevational view partially in section taken along the section 6—6 of FIG. 3 and viewed in the direction of the arrows.

As best shown in FIG. 6, spaced parallel support blocks 66 and 68 are secured to bed 60. Rods 70 and 72, as best shown in FIGS. 3 and 6, extend between blocks 66 and 68 in spaced parallel relation and are uniformly spaced above surface 62. Supports 74 and 76 are disposed in spaced parallel relation and are slidably mounted to rods 70 and 72 for movement therealong. First frame 78 is secured to supports 74 and 76 and is moveable therewith. Mounts 80 and 82, as best shown in FIG. 3, are secured to bed 60 on either side of frame 78. Pneumatic cylinder 84 is secured to mount 80 and piston rod 86 thereof engages and bears upon link 92 secured to and depending from frame 78.

Pneumatic cylinder 94 is secured to mount 82 and piston rod 96 extends therefrom and through link 98 which is secured to and depends from frame 78. Unlike piston rod 86, piston rod 96 has a nut 100 which permits the rod 96 to slide freely through aperture 101, toward the right as viewed in FIG. 3, without causing corresponding movement of frame 78. The nut 100 does, however, engage link 98 upon the piston rod 96 being retracted, or moved toward the left as viewed in FIG. 3, for causing corresponding movement of the frame 78. It can be noted that the cylinder 84 is substantially smaller than the cylinder 94, as is the corresponding piston rod 86 to rod 96. The piston 86 moves rapidly relative to piston 96 for thereby causing associated rapid movement of frame 78. The cylinder 94 is large relative to cylinder 84 and thereby provides a damping effect during movement of the frame 78 by the piston rod 86. In other words, the piston rod 96 limits the absolute movement of the frame 78 and acts as a shock absorber as the frame 78 is moved by the piston rod 86.

It will be readily appreciated that the orientation of pneumatic cylinders 84 and 94 and the corresponding pistons 86 and 96, respectively, may be reversed such that the frame 78 is pulled to the right as viewed in FIG. 3 rather than pushed. In such arrangement, nut 100 would be positioned on the opposite side of link 98. Further, it will be readily appreciated that the pneumatic cylinders 84 and 94 and the corresponding pistons 86 and 96, respectively, may be positioned adjacent each other on one side of frame 78.

As best shown in FIG. 3, electric motor 102 having a high speed rotating shaft 104 is secured to frame 78 by mounts 105. Router head 106 is secured by nut 108 to shaft 104 and carries cutter blades 110. Preferably, each of the blades 110 has a straight portion 112 and a V-portion 114 which bevels the lens blank, as will be further explained. It should be appreciated that the shaft 104 rotates on an axis which is parallel to the axis on which the frame 78 moves.

Bracket 116, as shown in FIGS. 3 and 6, is secured to frame 78 and is moveable therewith. Rod handle 118 extends therefrom and terminates in handle 120, as shown in FIG. 1. Rods 122 and 124 extend from bracket 116 oppositely to rod handle 118 and are received within apertures in block 126. Coil springs 128 and 130 are mounted to the rods 122 and 124, respectively, and adjustment knob 132 extends from block 126, for reasons to be explained later. Catch rod 134 extends from bracket 116 parallel to rods 122 and 124, as best shown in FIG. 3. Latch 136 extends downwardly from window 16 and has an aperture 138 through which rod 134 passes. In this way, shifting of frame 78 towards the left, as viewed in FIGS. 3 and 6, will cause the rod 134 to pass through the aperture 138 and therefore prevent opening of window 16.

Figure 5:
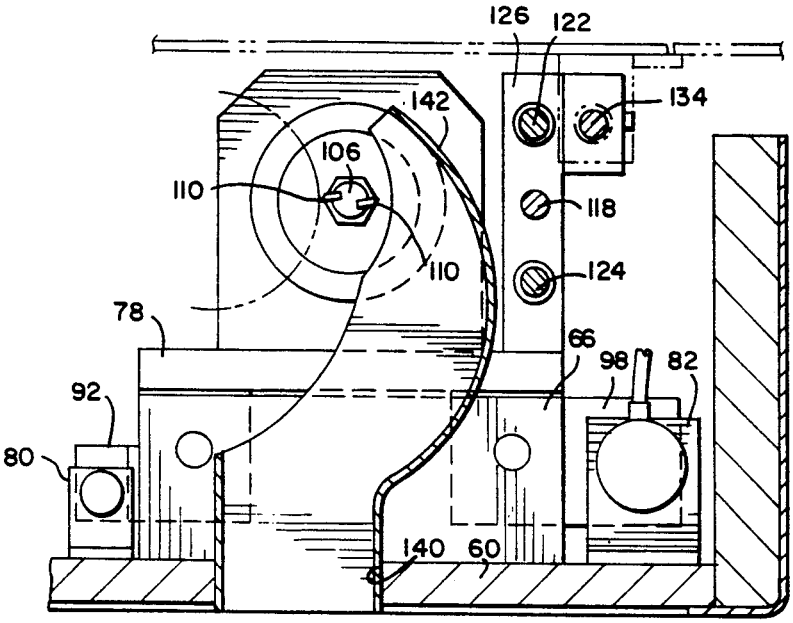
FIG. 5 is a fragmentary cross-sectional view taken along the section 5—5 of FIG. 3 and viewed in the direction of the arrows.

FIG. 5 discloses opening 140 in bed 60. Plastic shroud 142 is secured in opening 140 and extends upwardly therefrom and terminates proximate router 106. A vacuum assembly (not illustrated) is operatively connected with shroud 142 for evacuating dust and the like generated by router 106 during operation thereof. In this way, the dust and other particles do not fill the edger and shaper P and block viewing of the components thereof.

Figure 7:
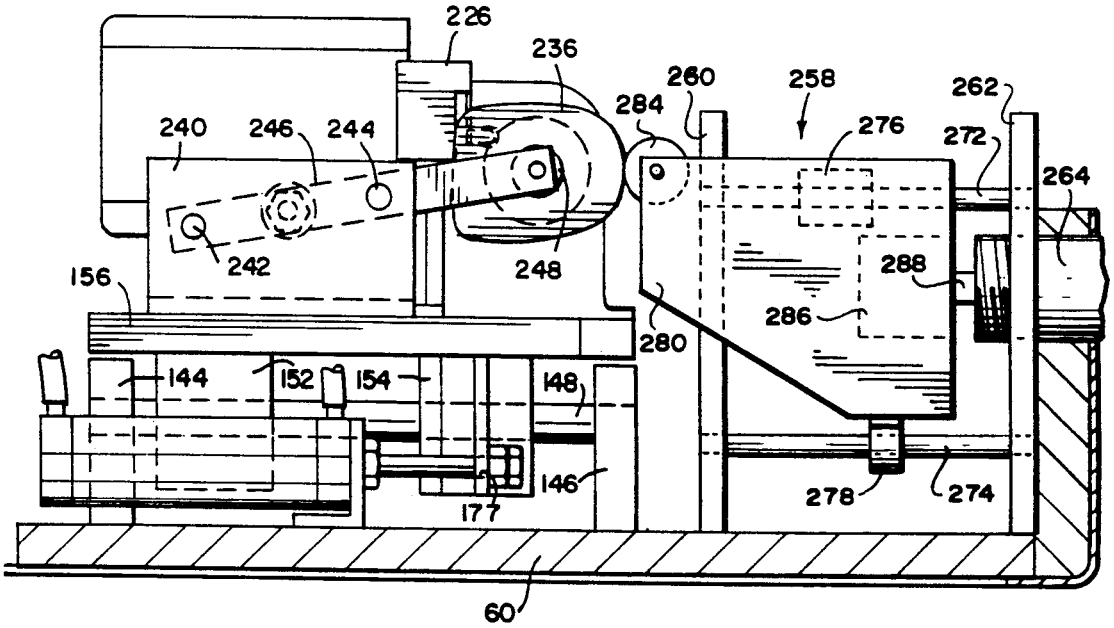
FIG. 7 is a fragmentary side elevational view partially in section.

As best shown in FIG. 7, support blocks 144 and 146 are mounted in spaced parallel relation to bed 60. Rods 148 and 150, as best shown in FIGS. 7 and 4, extend between blocks 144 and 146 in spaced parallel relation and are a uniform distance from surface 62, the distance being equal to that of rods 70 and 72 from bed 60. The rods 148 and 150 extend in a direction generally transverse to the direction in which the rods 70 and 72 extend. Supports 152 and 154 are disposed in spaced parallel relation and are slidably mounted to rods 148 and 150 for movement therealong. Second frame 156 is mounted to support 152 and 154 and is moveable therewith, as will be further explained.

As best shown in FIGS. 3 and 4, links 158 and 160 are secured to and extend outwardly from frame 156 along opposites sides thereof. Support blocks 162 and 164 are secured to bed 60 proximate links 158 and 160, respectively. Pneumatic cylinder 166 is secured to support block 162 and the piston rod 168 thereof is engaged with and bears upon link 158 in a manner similar to the engagement of rod 86 to link 92. Pneumatic cylinder 174 is likewise secured to its support block 164. The piston rod 176 thereof extends through an aperture 177 in link 160 and has lock nuts 178 mounted thereto. As with the piston rod 96, rod 176 may freely slide relative to the link 160 in a first direction but, in the opposite direction thereto, the nut 178 engages the link 160 and causes movement thereof. As with the cylinder and piston assemblies 84, 86 and 94, 96 respectively, of first frame 78, the cylinder and piston assemblies 166, 168, and 174, 176 move the second frame 156 along an axis which is generally transverse to the axis on which the first frame 78 moves. As before, the cylinder 166 is a high speed movement cylinder whereas the cylinder 174 acts as a damping cylinder, to prevent shocking impact with router 106.

It will be readily appreciated that the orientation of cylinders 166 and 174 and the corresponding pistons 168 and 176 may be reversed such that the pistons and cylinders pull frame 156 towards the bottom of the page of FIG. 3 rather than push. Further, the pneumatic cylinders 166 and 174 and the corresponding pistons 168 and 176 may be positioned directly adjacent each other on either of the sides of frame 156.

Motor 180 is secured to second frame 156 and extends generally transverse to the axis on which the router 106 rotates. Motor 180 is connected to transmission 182 from which shafts 184 and 186 extend in coaxial alignment generally transverse to the axis on which the second frame 156 moves. Shaft 184 has a coupling 187 from which shaft 188 extends in coaxial alignment. First blank holding member 190 is mounted for coaxial rotation with shaft 188 and has a pad 192 which engages plastic blank 194.

It can be noted in FIG. 3 that second frame 156 is generally L-shaped in plan. Support members 196 and 198 are secured to second frame 156 in spaced parallel relation. Wall members 200 and 20 extend therebetween and are likewise secured to second frame 156. Cylinder 204 is secured to support member 198 by lock nut 206. The piston rod 208 thereof extends through aperture 210 of support member 196 and has a cover 212 at the distal end thereof.

Arm 214 is secured to piston rod 208 and includes an extension member 216 which extends through a longitudinally extending slot in wall member 202. As best shown in FIG. 4, cover 218 is secured to extension member 216 and is moveable therewith for maintaining the longitudinally extending slot 220 closed to prevent the entrance of dirt or other contaminants.

Extension member 216 carries second blank holding member 222 which engages the blank 194 in coaxial alignment with first blank holding member 190. The blank holding member 222 permits the blank 194 to rotate on its central axis in response to rotation of shaft 184. Those skilled in the art will appreciate that displacement of rod 208 will cause second blank holding member 222 to approach or move away from blank 194 so as to cause the blank 194 to be clamped between the blank holding members 190 and 222 or to be released therefrom. Preferably, the pad 192 includes an adhesive for securing the blank 194 to block 191. It is also preferred that the blank holding member 190 be readily removable and replaceable on the shaft 188 so as to maximize the operation of the shaper P.

As best shown in FIG. 3, shaft 186 has cam 224 mounted thereto for coaxial rotation therewith. Switch 226 is mounted adjacent cam 224 and has a contact member 228 engaged with the cam 224 for determining the proper angular position of shaft 186.

First pattern holding member 230 is mounted to cam 224 for coaxial rotation therewith. Preferably, first pattern holding member 230 has pins 232 and 234 which are positioned in cooperating apertures in pattern 236. The pins 232 and 234 thereby prevent rotation of pattern 236 relative to the first pattern holding member 230. Therefore, the pattern 236 does not come out of position and cause the blank 194 to be cut to other than the prescribed shape. Similarly, because of switch 226, the pattern always is positioned in the same horizontal relation when operation is commenced.

Supports 238 and 240 are secured to second frame 156 in spaced parallel relation and extend parallel to support members 196 and 198. Rods 242 and 244 extend between supports 238 and 240. It can be noted in FIG. 7 that the rod 244 is a slight distance above the second frame 156 relative to the rod 242. Arm 246 is mounted to the rods 242 and 244 for movement therealong between the support members 238 and 240. Arm 246 has second pattern holding member 248 mounted to the distal end thereof. Second pattern holding member 248 rotates on an axis coaxial with shaft 186. Second pattern holding member 248 has contact member 250 which engages pattern 236.

Pneumatic cylinder 252 is secured to support member 238 by lock nut 254. The piston rod 256 thereof is secured to arm 246 and causes the arm 246 to be moved on the rods 242 and 244. Those skilled in the art will appreciate that displacement of rod 256 will cause corresponding movement of the arm 246 such that the pattern 236 will be clamped or released from between the pattern holding members 230 and 248.

As best shown in FIGS. 3 and 7, pattern engaging assembly 258 is secured to bed 60 through supports 260 and 262. Support 262 includes a threaded aperture for receiving threaded rod member 264. Threaded member 264 includes a shaft 266 extending therefrom and having a handle 267, as best shown in FIG. 1, exterior of bottom member 10. Preferably, handle 267 has gradients 268 equiangularly marked thereabout. Locator 270 has slot 271 aligned with the gradients 268. Rotation of handle 267 and alignment with one of the gradients 268 by slot 271 causes the threaded member 264 to move inwardly and outwardly relative to the pattern engaging assembly 258.

Pattern engaging assembly 258 further includes a pair of rods 272 and 274 fixed to and extending between supports 260 and 262. Bearing sleeves 276 and 278 are mounted on rods 272 and 274 respectively. A pair of vertically extending walls 280 and 282 are each secured to the bearing sleeves 276 and 278 at opposite ends thereof, as best seen in FIGS. 3 and 7. A pattern engaging roller 284 extends between and is rotatably mounted to walls 280 and 282. A pneumatic cylinder 286 extends between and is secured to walls 280 and 282. The corresponding piston 288 engages threaded rod member 264. As shown in FIG. 7, the piston 288 is in the fully extended position. Thus, when the piston 288 is retracted into cylinder 286, the pattern engaging assembly 258 can move to the right as viewed in FIG. 7.

The pattern engaging roller 284 may be moved inwardly relative to the pattern 236 so that adjustments in the size of the cut blank 194 may be accomplished with precision through the micrometer assembly provided by the gradients 268 and the locator 270. The pattern engaging roller 284 may be moved outwardly because of pressure from second frame 156 and the inward movement of piston 288.

Figure 9:
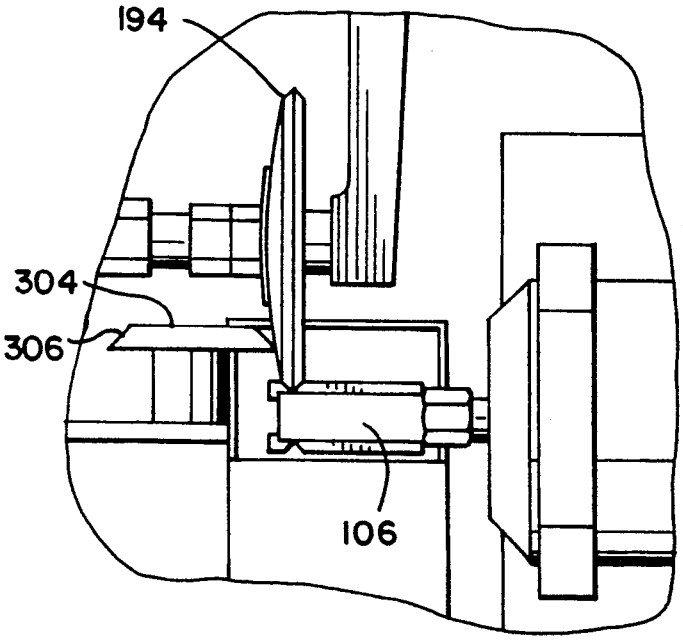
FIG. 9 is a top plan view illustrating the device in the finish position.

As best shown in FIG. 3, arm 298 extends from bracket 116 and carries support 300 at the distal end thereof and the height of support 300 can be adjusted through knob 132. Shaft 302 is mounted for rotation to support 300 and has wheel 304 at the distal end thereof. As can be seen in FIGS. 3 and 9, wheel 304 has an angled periphery 306 which is engaged with the blank 194 during the cutting operation thereof. In this way, the periphery 306 engages blank 194. It can be noted in FIG. 9 that the periphery 306 is radially inwardly spaced from the V-shaped beveled edge of the blank 194.

FIG. 4 discloses support block 308 to which solenoid block 310 is mounted. The specifics of the solenoid block 310 will be described in connection with FIG. 10. The solenoid block 310 includes five solenoid valves 312, 314, 316, 318 and 319. Solenoid 312 controls the flow of air to and from cylinders 204 and 252 so that arms 214 and 246 are displaced to clamp and unclamp lens blank 194 and pattern 236. More specifically, air is directed through port A of solenoid 312 to displace arms 214 and 246 to clamp the lens blank 194 and pattern 236, respectively. Under these circumstances, air is exhausted through port B. When it is desired to unclamp the lens blank 194 and pattern 236, air is supplied through port B and exhausted through port A.

Solenoid valve 314 controls the flow of air to and from the cylinder 174. Specifically, air is supplied through port A and resistor 323 to cause the piston 176 to be displaced toward the pattern engaging roller 284. The opposing side of cylinder 174 is exhausted through port B of solenoid valve 314. A solenoid valve 320 as well as a restrictor and check valve assembly 322 are positioned intermediate port B and the cylinder 174. A variable resistor is connected to the flow control solenoid valve 320 to control the rate at which the solenoid valve 320 is opened and closed to regulate the exhaust of air from cylinder 174. Generally speaking, the faster the flow control solenoid 320 is opened and closed the faster the frame 156 will be displaced relative to the router 106. The significance of the flow solenoid 320 will be described in greater detail below. Air is supplied through port B of solenoid valve 314 and exhausted through port A to move the frame 156 away from the router 106.

The solenoid valve 316 controls the flow of air to and from the cylinder 94. Specifically, air is supplied through port A and exhausted through port B to cause the piston 96 to move to the right as viewed in FIG. 3. The reverse causes the piston 96 to move to the left as viewed in FIG. 3. A restrictor 326 is positioned intermediate port B and the cylinder 94. A restrictor and check valve assembly 328 is positioned between port A and cylinder 94.

Solenoid valve 318 controls the supply of air to the cylinder 286. Air is supplied through port A and exhausted through port B of solenoid valve 318 to maintain the piston 288 in the fully extended position illustrated in FIG. 7. Check valve and restrictor assemblies 330 and 332 are disposed between port A and the cylinder 286. Air is supplied through port B and exhausted through port A to cause the piston 288 to retract so that the pattern engaging assembly 258 may be moved away from the pattern 236. Solenoid valve 319 controls the flow of air through an alternative exhaust line for pneumatic cylinder 174. The alternative exhaust line includes a check valve 331. Normally, air is supplied through port B of solenoid valve 319 to prevent the cylinder 174 from exhausting through the alternative line.

Air is supplied to the solenoid block 310 via air inlet 48, line 333, connector 334 and line 336. Air filter 46, line gauge 338 and line regulator 340 are disposed between air inlet 48 and connector 334. The line gauge 338 permits an operator to observe the air pressure in line 333. Further, an operator may readily regulate the pressure in line 333 through line regulator 340.

Line 342 extends from connector 334 and supplies air to pattern tracking cylinder 166 and lens tracking cylinder 84. Tracking pressure gauge 24 and tracking regulator 26 are disposed in line 342 intermediate connector 334 and cylinders 166 and 84. Using gauge 24 and regulator 26 an operator can monitor and adjust the pressure in line 342.

Figure 8:
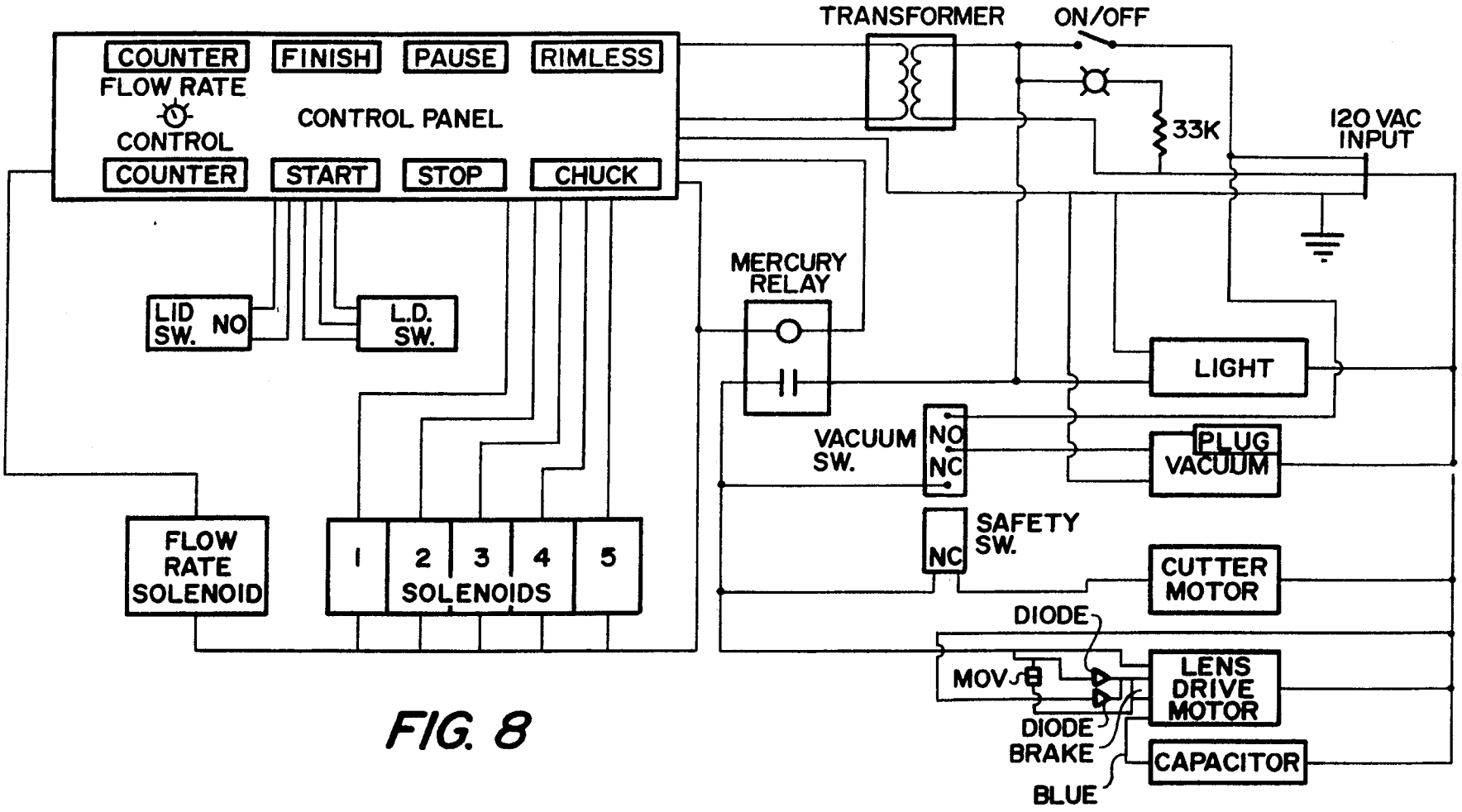
FIG. 8 is a schematic view illustrating the wiring diagram of the preferred embodiment of the present invention.

FIG. 8 illustrates the wiring schematic which controls the operation of plastic lens finisher and shaper P. The cutter motor is connected to a mercury switch 22 affixed to the underside of cover member 12 so that the motor will not operate when the cover member 12 is raised. Similarly, the vacuum which evacuates air and dust through shroud 142 is in circuit connection with the circuit motor as is the lens drive motor which rotates the pattern and lens blank.

FIG. 8 also illustrates the finish push button, the start push button which initiates the operation of the device, the pause push button, emergency stop button, the rimless push button, the chuck push button and the on/off push button. These push buttons correspond with the push buttons 30, 32, 34, 36, 38, 40 and 41, shown in FIG. 1, which make up the control panel and have for their purpose the selective operation of the shaper and finisher P. The start push button 32 is in circuit connection with the mercury switch 22 to prevent the cutter motor 102 from being operated when the window 16 is in the up position. The solenoid block 310 is also in circuit connection with the push buttons. Also in circuit connection with the start button is a relay which prevents operation of the device.

The control panel further includes a flow rate control knob 43 which is in circuit connection with a variable resistor. The variable resistor is in turn connected to flow control solenoid valve 320. The flow rate control knob 43 is adjusted to vary the time period per lens revolution during which the solenoid valve 320 is maintained open. Solenoid valve 320 is opened and closed one time for each lens revolution. Thus, the longer the valve 320 is maintained open during each lens revolution the faster the frame 156 will advance.

OPERATION

The preferred method of operating the plastic lens shaper and finisher P will be described hereinafter. The plastic lens shaper and finisher P is relatively simple to operate because of the pneumatic cylinder and piston assemblies which drive the first frame 78 and the second frame 156 and which operate the pattern clamping mechanism, the lens clamping mechanism, and the pattern engaging assembly 258.

Initially, the connection 48 must be made with a source of pressurized air and, naturally, power provided through plug connections 50 and 52. The on/off push button 41 is then depressed to power the system and to operate the light 20 under the window 16. The handle 120 is then slid to the right by movement of frames 78 at the end of the previous cycle, as viewed in FIG. 1, and the window 16 may then be raised because the rod 134 will have been removed from the aperture 138 in the latch 136. The appropriate pattern 236 is then mounted to the pins 232 and 234 of first pattern holding member 230. A lens blank 184 having affixed thereto pad 192 and block 191 is indexed with first pattern holding member 190.

The chuck push button 40 is depressed which thereby causes the arm 246 to be displaced so that the contact member 250 engages the pattern 236 and clamps the pattern 236 between the first and second pattern holding members 230 and 248, respectively. Simultaneously, the piston rod 208 likewise shifts and thereby causes the second blank holding member 222 to engage the lens blank 194 to secure the same between the first and second blank holding members 190 and 222. The window 16 may then be lowered.

At this time, or even earlier, the handle 267 is rotated to cause the appropriate gradient 268 to be aligned in the notch 271 of the locator 270 so that the proper size is selected. As previously explained, rotation of the handle 267 causes cooperating inward movement of the pattern engaging assembly 258 so that the pattern engaging roller 284 is moved inwardly. Naturally, rotation of handle 267 in the opposite direction will permit the pattern engaging assembly 258 to slide in the opposite direction.

If the lens blank has a sufficiently large diameter, for example greater than approximately 82 millimeters, the operator will set the plastic lens shaper and finisher P such that it performs a roughing cycle and a finishing cycle. During the roughing cycle, the frame 156 is displaced relative to the router 106 at a rate of between 1 millimeter to 8 millimeters per lens revolution. The roughing cycle lasts for approximately 30 seconds and cuts the lens blank to within 4 millimeters of its final shape and size. To perform the roughing cycle the operator simultaneously depresses the pause 34 and rimless 38 buttons prior to activation of the start button 32. Also, the operator selects the desired setting for the flow rate control knob 43.

If the flow rate control knob 43 is positioned at its furthest counterclockwise position the frame 156 will be displaced relative to router 106 at a rate of one millimeter per lens revolution. On the other hand, if the flow rate control knob is positioned at its furthest clockwise location, the frame 156 will be displaced relative to router 106 at a rate of 8 millimeters per lens revolution. By depressing the rimless button 38, the operator is able to prevent the carriage 78 from moving to the right where the V-shaped notch 114 is positioned directly adjacent the lens blank 194. Depression of the pause button 34 maintains the piston 288 in the fully extended position. The depression of both the pause button 34 and the rimless button 38 will cause the solenoid valve 320 to activate at the desired time. With the pause button 34 and the rimless button 38 depressed, the operator then activates the start button 32. This results in the frame 156 advancing to a position where the outer periphery of lens blank 194 is positioned directly adjacent router 106. At this location, the frame 156 is momentarily maintained stationary.

Figure 10:
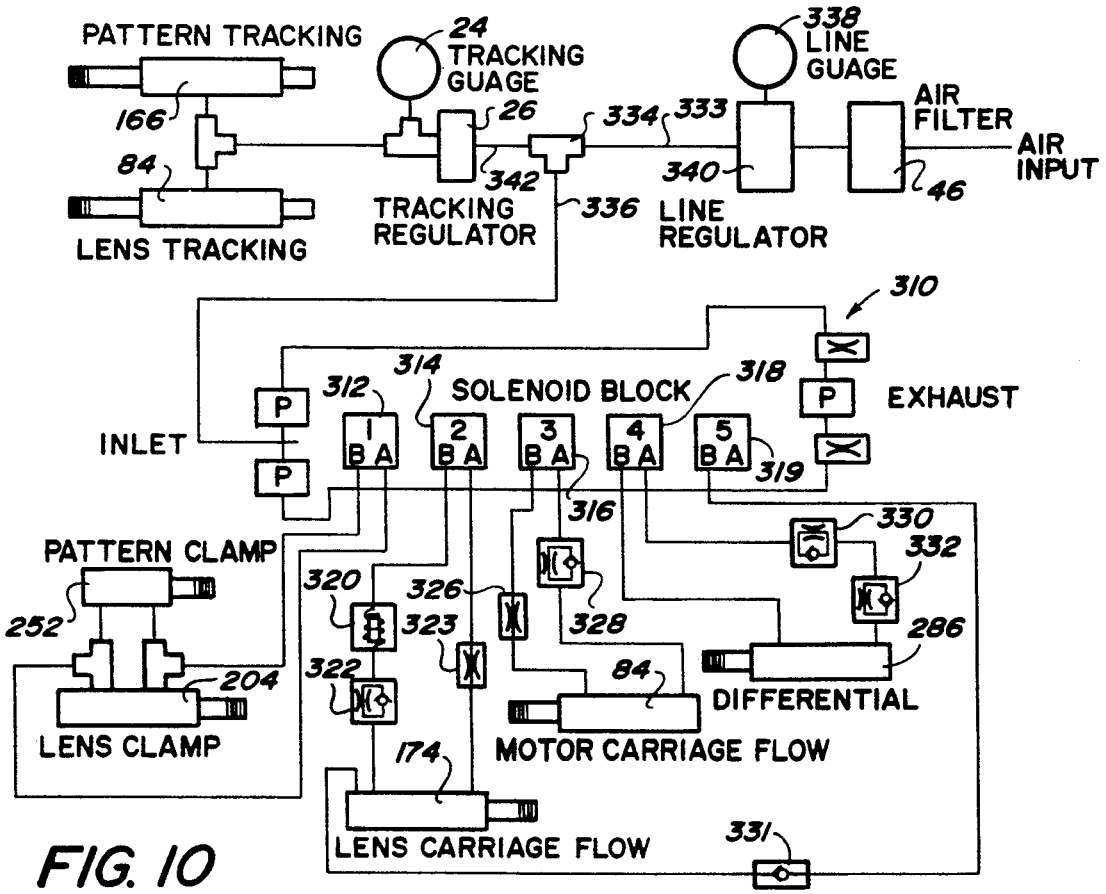
FIG. 10 is a schematic view illustrating the pneumatic control system of the invention.

Subsequently, the solenoid valve 320 activates and the frame 156 advances at a rate corresponding to the setting of the flow rate control knob 43. As seen in FIG. 10, the solenoid valve 320 controls the rate at which air is exhausted from cylinder 174. It has been found that by regulating the exhaust rather than the supply, then greater control over the rate of displacement of frame 156 can be achieved. Further, positioning solenoid valve 320 adjacent cylinder 174 reduces the distance of the line extending therebetween. This feature also enhances the control over the rate of displacement of frame 156.

Once the roughing cycle has been completed, the frame 156 is maintained at a stationary position. The operator then releases the pause and rimless buttons 34 and 38, respectively. The release of either the rimless button 38 or pause button 34 causes the solenoid valve 320 to be maintained in an open position. Thus, the rate at which the assembly 156 is fed to the router 106 is increased to approximately 12 millimeters per lens revolution. The release of the rimless button 38 will cause the frame 78 to move to the right to position the V-shaped notch 114 directly adjacent lens blank 194. The release of the pause button will further cause the piston 288 to retreat into cylinder 286. The force exerted by piston 168 will cause the frame 156 to advance such that the lens blank 194 engages the substantially V-shaped portion 114 of router 106 to complete the sizing of the lens blank 194 as well as forming a bevel in the outer periphery thereof. Of course, if the lens blank 194 is not to be formed with a beveled edge, the operator merely releases the pause button while maintaining the rimless button depressed.

If the lens blank 194 is sufficiently small, then it is not necessary to perform the roughing operation. Where the lens blank 194 is small enough and it is desired that a beveled edge be formed thereon, the operator depresses the start button 32 without depressing either the pause button 34 or the rimless button 38. This procedure will cause the frame 156 to advance at approximately 12 millimeters per lens blank revolution. Where the lens blank 194 is sufficiently small and it is not desired to have a beveled edge formed thereon, the operator depresses the rimless button 38 prior to depressing the start button 32.

If it is desired to merely make minor adjustments to a cut lens, the frame 156 can be advanced at a faster rate. To accomplish this, the finish button is depressed prior to activating the start button, thereby causing air to be exhausted through port B of solenoid valve 319 and releasing the pressure on check valve 331. Thus, air will be exhausted from cylinder 174 through the alternative line. As is readily evident from FIG. 10, the alternative line does not have a restrictor unlike the main exhaust line. Thus, air will be exhausted from cylinder 174 at a faster rate, thereby causing frame 156 to advance at a faster rate.

Those skilled in the art will appreciate, and as illustrated in FIG. 7, that the pattern 236 is a non-uniform contour such that the periphery thereof is not a constant distance from the central rotational axis thereof. The overall effect is that the engagement of the pattern 236 with the roller 284 causes the frame 156 to be shifted toward and away from the router 106 as dictated by the contour of the pattern 236. The relatively small cylinder 166 is not pressurized by an amount which would prevent the piston 168 from being displaced inwardly toward the cylinder 166 when forced in that direction by the contour of the pattern 236.

While this preferred embodiment is described with reference to a physical pattern 236, those skilled in the art will appreciate that modern computer techniques are sufficient to permit digitization of a pattern. Digitization would avoid the necessity of the physical pattern.

Should the pattern need to be changed, because a different type lens is to be cut, for example, then the operator needs merely to press the chuck push button 40 in order to access the pattern 236 and permit its changing. The disclosed invention also makes it possible to cut a pattern from a previously finished lens. This is because the cutting pressure exerted by the piston 168 is so relatively slight that the pattern material will not become distorted. Now, because the right and left lenses are mirror images of each other, a pattern can be made from one lens to permit the cutting and finishing of the other.

ALTERNATIVE EMBODIMENT

Figure 11:
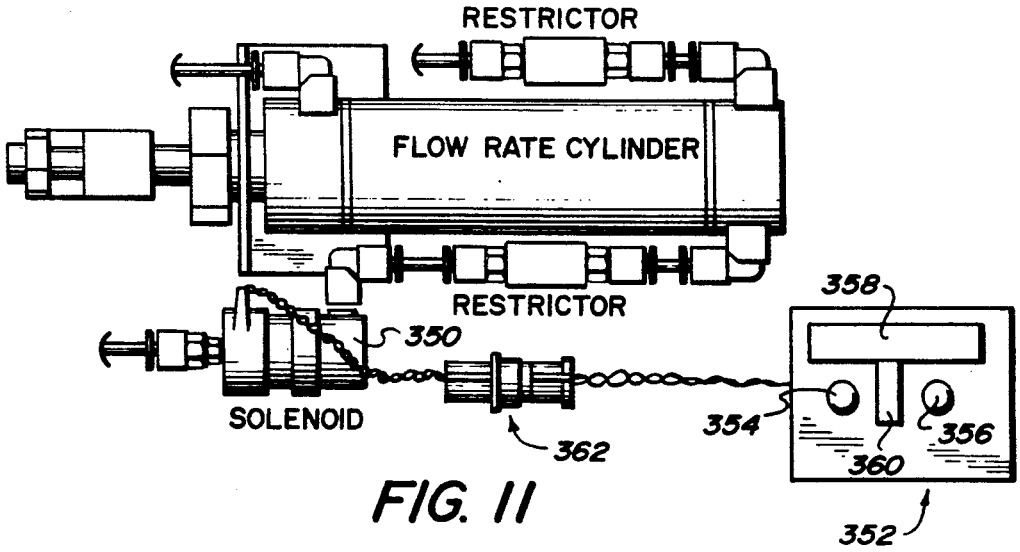
FIG. 11 is a top plan view of the retrofit kit assembly.

An alternative embodiment of the present invention will be described hereinafter with reference made to FIG. 11.

A plastic lens shaper and finisher having all of the elements described in the preferred embodiment of the invention with the exception of the flow control system has been previously known. In other words, a plastic lens shaper and finisher has been available which is identical to plastic lens shaper and finisher P in every respect with the exception of the flow control solenoid 320, the variable resistor and the flow control knob 43. Accordingly, these previously known lens shapers and finishers are unable to advance the frame 156 at a slower rate in a roughing cycle than in a finishing cycle.

An alternative embodiment of the present invention is directed to a retrofit kit assembly which can readily modify previously known lens shapers and finishers to include the flow control feature of the present invention. FIG. 11 illustrates the elements of the retrofit kit assembly. More specifically, the retrofit kit assembly includes a flow control solenoid valve 350 and an actuator 352. A template is provided with the retrofit kit assembly. The template has a configuration which corresponds to the right side of previously known lens shaper and finishers. The template has a pair of guide holes which are used to drill holes in the previously known lens shaper and finisher to accommodate the actuator 352. Once the holes have been drilled in the lens shaper and finisher, then the knobs 354 and 356 on the actuator 352 are removed. Further, the protective layers 358 and 360 of adhesive strips formed on the actuator 352 are removed. The supporting shafts of knobs 354 and 356 are inserted through the pair of holes formed in the right side of the shaper and finisher and pressure is applied to the actuator 352 to secure the same to the right side of the lens shaper and finisher. The knobs 354 and 356 are repositioned on the corresponding shafts. The solenoid valve 350 is connected to the pneumatic cylinder corresponding to cylinder 174 of lens shaper and finisher P. Electrical connectors 362 connect the actuator 352 to the solenoid valve 350.

The operation of a lens shaper and finisher retrofitted with the control feature will be described hereinafter. The control knob 356 corresponds to the flow control knob 43 of the preferred embodiment and operates in the same manner. The only difference in operation between a device having the retrofit assembly and the lens shaper and finisher P is that the operator must depress the actuator knob 354 in combination with the depression of the rimless button 40 and the pause button 34 to achieve the roughing cycle. The knob 354 actuates the solenoid valve 350 to open and close at a rate corresponding to the frequency set by the control knob 43. Once the roughing cycle is complete, the operator releases the actuator 354 as well as the pause and rimless buttons. Release of the actuator 354 maintains the solenoid valve 350 in the open position.

While this invention has been described as having a preferred design, it is understood that it is capable of further modifications, uses and/or adoptions of the invention following in general the principle of the invention and including such departures from the present disclosure as come within the known or customary practice in the art to which to invention pertains and as may be applied to the central features hereinbefore set forth, and fall within the scope of the invention and of the limits of the appended claims.

I claim:

1. Method of forming lenses for insertion into a frame, comprising the steps of:

a) providing chuck means for supporting a lens blank and providing a lens pattern means;

b) providing cutting means for cutting the lens blank to conform to the lens pattern means;

c) providing displacement means for displacing the cutting means relative to the chuck means;

d) displacing the cutting means relative to the chuck means at a first feed rate during a rough cutting cycle in which the lens blank is given a shape generally conforming to the lens pattern means; and e) displacing the cutting means relative to the chuck means at a second feed rate during a finish cutting cycle in which the lens blank is given a shape conforming to the lens pattern means, the second feed rate being different than the first feed rate.

2. A method as in claim 1, further including the step of:

a) displacing the chuck means at the first and second rates to perform the corresponding rough and finish cutting cycles, the first rate being slower than the second rate.

3. A method as in claim 1, further including the steps of:

a) operably connecting a first piston and cylinder assembly to the chuck means for causing reciprocation thereof, the first piston and cylinder assembly being adapted to be connected to a fluid supply means; and, b) operably connecting control valve means to the first piston and cylinder assembly for controlling the flow of fluid from the fluid supply means to the first piston and cylinder assembly.

4. A method as in claim 3, further including the steps of:

a) providing first and second control valves connected in series;

b) positioning the first control valve adjacent the first piston and cylinder assembly; and, c) positioning the second control valve remove from the first piston and cylinder assembly and upstream of the first control valve.

5. A method as in claim 4, including the further step of:

a) providing rate varying means for varying the rate at which the first control valve is opened and closed.

6. A method as in claim 5, including the further step of:

a) providing a variable resistor for varying the rate at which the first control valve is opened and closed.

7. A method as in claim 1, including the further step of:

a) displacing the cutting means in a horizontal plane during the rough and finish cutting cycles.

8. A method as in claim 4, including the further steps of:

a) maintaining the second valve in an open position; and b) opening and closing the first control valve a plurality of times when the second control valve is in the open position.

9. An apparatus for forming lenses for insertion into a frame, comprising:

a) chuck means for supporting a lens blank;

b) cutting means for cutting the lens blank to conform to a lens pattern means;

c) displacement means for displacing said cutting means relative to said chuck means; and d) control means for controlling the rate of relative displacement of said cutting means and said chuck means, said control means includes a first control valve and rate varying means for varying the rate at which the control valve is opened and closed for varying the rate of relative displacement of said cutting means and said chuck means so that the lens blank is cut to conform to the lens pattern means.

10. An apparatus as in claim 9, wherein:

a) said displacement means includes means for displacing said cutting means relative to said chuck means in a substantially horizontal plane.

11. An apparatus as in claim 9, wherein:

a) said displacement means includes means for displacing said chuck means between a first position wherein the lens blank engages said cutting means and a second position wherein the lens blank is removed from said cutting means.

12. An apparatus as in claim 9, wherein:

a) said first control valve is a solenoid valve; and b) a second control valve is connected in series with said first control valve, said second control valve is a restrictor and check valve assembly.

13. An apparatus as in claim 11, wherein:

a) said displacement means includes first and second piston and cylinder assemblies operably connected to said chuck mean for causing reciprocation thereof, said first piston and cylinder assembly includes means for damping movement of said chuck means.

14. An apparatus as in claim 13, wherein:

a) the cylinder of said first piston and cylinder assembly is of a greater size than the cylinder of said second piston and cylinder assembly.

15. An apparatus as in claim 14, wherein:

a) said first control valve is operably connected to said first piston and cylinder assembly to regulate the flow of fluid thereto.

16. An apparatus as in claim 15, wherein:

a) said rate varying means includes a variable resistor.

17. A retrofit kit for adapting a lens shaping machine to displace a lens blank relative to a router at a first feed rate to perform a rough cutting cycle and a second feed rate to perform a finish cutting cycle, comprising;

a) control means for controlling the rate of relative displacement between a lens blank and a router;

b) said control means includes a control valve and rate varying means for varying the rate at which said control valve is opened and closed; and, c) actuation means for actuating said control means.

18. An apparatus as in claim 17, wherein:

a) said control valve is a solenoid valve.

19. An apparatus as in claim 18, wherein:

a) said rate varying means includes a variable resistor.

20. An apparatus as in claim 17, further including:

a) a template for positioning said actuating means on a lens shaping machine.

21. The method of claim 1, including the step of:

a) providing a pattern as the lens pattern means.

22. The method of claim 21, including the step of:

a) operably securing the pattern to the chuck means.

23. The apparatus of claim 9, further comprising:

a) a lens pattern is operably secured to said chuck means for providing the lens pattern means.

24. The apparatus of claim 23, wherein:

a) said chuck means is movable, and said lens pattern is movable therewith.

* * * * *